US007410238B2

(12) United States Patent
Morita

(10) Patent No.: US 7,410,238 B2
(45) Date of Patent: Aug. 12, 2008

(54) INK RECORDING APPARATUS

(75) Inventor: Yuukichi Morita, Kahoku (JP)

(73) Assignee: PFU Limited, Ishikawa (JP)

( * ) Notice: Subject to any disclaimer, the term of this patent is extended or adjusted under 35 U.S.C. 154(b) by 379 days.

(21) Appl. No.: 11/312,455

(22) Filed: Dec. 21, 2005

(65) Prior Publication Data

US 2006/0139399 A1 Jun. 29, 2006

(30) Foreign Application Priority Data

Dec. 24, 2004 (JP) ..... 2004-373092

(51) Int. Cl.
*B41J 2/165* (2006.01)
*B41J 2/215* (2006.01)

(52) U.S. Cl. ..... 347/34; 347/29; 347/32; 347/83

(58) Field of Classification Search ..... 347/34, 347/29, 32, 83, 22
See application file for complete search history.

(56) References Cited

U.S. PATENT DOCUMENTS 4,024,548 A * 5/1977 Alonso et al. ..... 347/34
4,736,212 A * 4/1988 Oda et al. ..... 347/55
6,435,648 B1 * 8/2002 Murakami et al. ..... 347/29

FOREIGN PATENT DOCUMENTS

JP 57205157 * 12/1982
JP 10-264412 10/1998

* cited by examiner

*Primary Examiner*—Shih-Wen Hsieh

(57) ABSTRACT

An ink recording apparatus is operable to eject ink to a medium transported in a transport path in a transport direction. An ink head includes a nozzle on a bottom surface opposed to the transport path, and is operable to eject the ink from the nozzle to the medium. A holder is adapted to hold the ink head and to cover the bottom surface, and includes a first opening corresponding to the nozzle. An absorber is adapted to cover a part of the holder which is opposed to the transport path and is adjacent to the first opening, and includes a second opening corresponding to the nozzle. The second opening is adjacent to the first opening. A mask is adapted to be arranged between the absorber and the transport path, and includes a third opening corresponding to the nozzle. At least one of an end portion of the second opening and an end portion of the third opening protrudes greater than an end portion of the first opening at least in the transport direction and an opposing direction opposed to the transport direction.

15 Claims, 8 Drawing Sheets

INK RECORDING APPARATUS

BACKGROUND OF THE INVENTION

The present invention relates to an ink recording apparatus, and particularly to an ink recording apparatus which ejects ink from an ink head onto a medium according to printing data thereby to perform printing.

An ink head used in an ink recording apparatus is characterized in that miniaturization can be facilitated, a high accurate image can be recorded at a high speed, and the image can be recorded on plain paper without requiring special processing. Therefore, the ink recording apparatus is applied to various apparatuses such as a printer, a scanner in-printer (built-in-printer), and the like.

However, the ink ejected from the ink head does not attach onto the whole of the surface of a medium, but a part of ink splashes round and ink mist is produced. In the ink recording apparatus, occurrence of mist, nozzle stain, and mask stain due to this ink mist is not avoided, which obstructs improvement of printing quality. The mist means that the ink which has become misty attaches to other portion than the desired portion thereby to cause difficulty in seeing a print image. The nozzle stain means that the ink which has become misty attaches to a nozzle gradually thereby to drop from the nozzle onto paper. The mask stain means that the ink which has become misty attaches to a mask surface and transfers to the paper, whereby the paper is stained with the ink.

It is said that the mist, the nozzle stain, and the mask stain are caused by static electricity. This static electricity is caused, for example, by friction between paper and a transport roller, and friction between paper and a transport guide. The ink that has been ejected and become misty is caught by this static electricity, and attaches to the paper, the nozzle, and the mask, thereby to cause the mist, the nozzle stain, and the mask stain respectively.

Therefore, many technologies for preventing occurrence of the stains due to static electricity have been proposed. For example, a technology has been proposed in which a charge member that is electrically insulated is provided inside a recording apparatus, the static electricity is generated in the charge member during recording, and ink mist produced during recording is attached to the charged charge member, whereby stains on other points inside the recording apparatus are prevented (refer to JP-A-10-264412).

In the usual ink recording apparatus (ink jet type printer), the stains due to the ink mist can be effectively prevented by measures for static electricity.

However, according to the investigation by the present inventors, in a printer of a type in which printing (recording) is performed while transporting paper (medium) at a high speed (hereinafter, referred to as a high-speed type), such as a scanner in-printer, it has been found that the following characteristic problems are produced.

Namely, in the high-speed type printer, the stains due to the ink mist cannot be effectively prevented only by the measures for static electricity, and it has been found that the stains due to the ink mist are caused not only by the static electricity but also by blow produced by transport of the paper (medium) (hereinafter, referred to as transport blow). Namely, in case that the paper (medium) is transported at a high speed, the transport blow is produced with this paper transport, and a droplet (shot) of the ink that has been ejected and become misty flows by this transport blow and attaches to the paper, the nozzle and the mask, whereby the mist, the nozzle stain, and the mask stain are caused respectively. Further, in the high-speed type printer, since the paper (recorded medium) is transported at a high speed, a large amount of static electricity is also produced. Therefore, it is been found that measures for static electricity which does not conflict with the measures for transport blow must be taken.

SUMMARY

It is therefore an object of the invention is to provide an ink recording apparatus which prevents stains due to ink mist and improves recording quality.

In order to achieve the object, according to the invention, there is provided an ink recording apparatus, operable to eject ink to a medium transported in a transport path in a transport direction, the ink recoding apparatus comprising:

an ink head, including a nozzle on a bottom surface opposed to the transport path, and operable to eject the ink from the nozzle to the medium;

a holder, adapted to hold the ink head and to cover the bottom surface, and including a first opening corresponding to the nozzle;

an absorber, adapted to cover a part of the holder which is opposed to the transport path and is adjacent to the first opening, and including a second opening corresponding to the nozzle; and a mask, adapted to be arranged between the absorber and the transport path, and including a third opening corresponding to the nozzle, wherein at least one of an end portion of the second opening and an end portion of the third opening protrudes greater than an end portion of the first opening at least in the transport direction and an opposing direction opposed to the transport direction.

With this construction, for example, in a high-speed type printer such as a scanner in-printer, even if the transport blow is produced by high-speed transport of the medium such as paper, it is possible to prevent the transport blow from blowing directly against the ejection part of the ink head, which will be described later, and it is possible to greatly lessen influences which the transport blow has on the ink. Therefore, it is possible to prevent a droplet (shot) of ink that has been ejected and become misty from flowing by this transport blow. Hereby, it is possible to prevent the mist, the nozzle stain and the mask stain from being caused respectively by the attachment of the ink mist onto the paper, the nozzle and the mask due to the transport blow. In result, according to the invention, the stains due to the ink mist can be prevented, and recording quality of the ink recording apparatus can be improved.

The end portion of the second opening may protrude greater than the end portion of the first opening and the end portion of the third opening.

The ink recording apparatus may include an in-printer that performs printing on paper processed by an image scanner.

The recording apparatus may further comprise a roller, comprised of a conductive material, and adapted to transport the medium, the roller located at an upstream side of the ink head in the transport direction.

In this case, without obstructing the prevention unit for the mist, the nozzle stain and the mask stain which are caused by the transport blow, it is possible to prevent the static electricity from being produced in the medium such as paper.

The conductive material may include urethane.

The conductive material may include metal.

The recording apparatus may further comprise the guide, provided along the transport path, and including a static electricity remover operable to remove static electricity.

In this case, without obstructing the prevention unit for the mist, the nozzle stain and the mask stain which are caused by the transport blow, it is possible to remove the static electricity produced in the medium such as the paper that is transported at a high speed.

The static electricity remover may include at least one of a static electricity removing bar provided at at least a part of the guide and a grounding member by which at least a part of the guide is grounded.

The recording apparatus may further comprise a pair of rollers, adapted to transport the medium, and located at an upstream side of the ink head in the transport direction, the rollers may be arranged at opposite sides of the transport path so that a line connecting axes of the rollers is inclined with respect to the transport path.

The absorber may be comprised of an insulating felt.

The absorber may be comprised of insulating and hydrophilic continuous foam urethane.

The absorber may be comprised of conductive and hydrophilic continuous foam urethane.

In this case, even if the ejected ink droplet flows by the transport blow, the ink droplet attached to the absorber is absorbed, whereby the cause of the mist, the nozzle stain and the mask stain can be eliminated.

According to the invention, there is also provided an ink recording apparatus, operable to eject ink to a medium transported in a transport path in a transport direction, the ink recoding apparatus comprising:

an ink head, including a nozzle opposed to the transport path, and operable to eject the ink from the nozzle to the medium;

a holder, holding the ink head, and including a first opening corresponding to the nozzle;

an absorber, including a second opening corresponding to the nozzle and the first opening; and a mask, including a third opening corresponding to the nozzle, the first opening and the second opening, wherein the first, second and third openings are arranged in this order from the nozzle toward the transport path, and at least one of the second opening and the third opening is smaller than the first opening.

The at least one of the second opening and the third opening may be smaller than the first opening at least in the transport direction.

The second opening may be smaller than the first opening and the third opening.

DETAIL DESCRIPTION OF PREFERRED EMBODIMENTS

Figure 1:
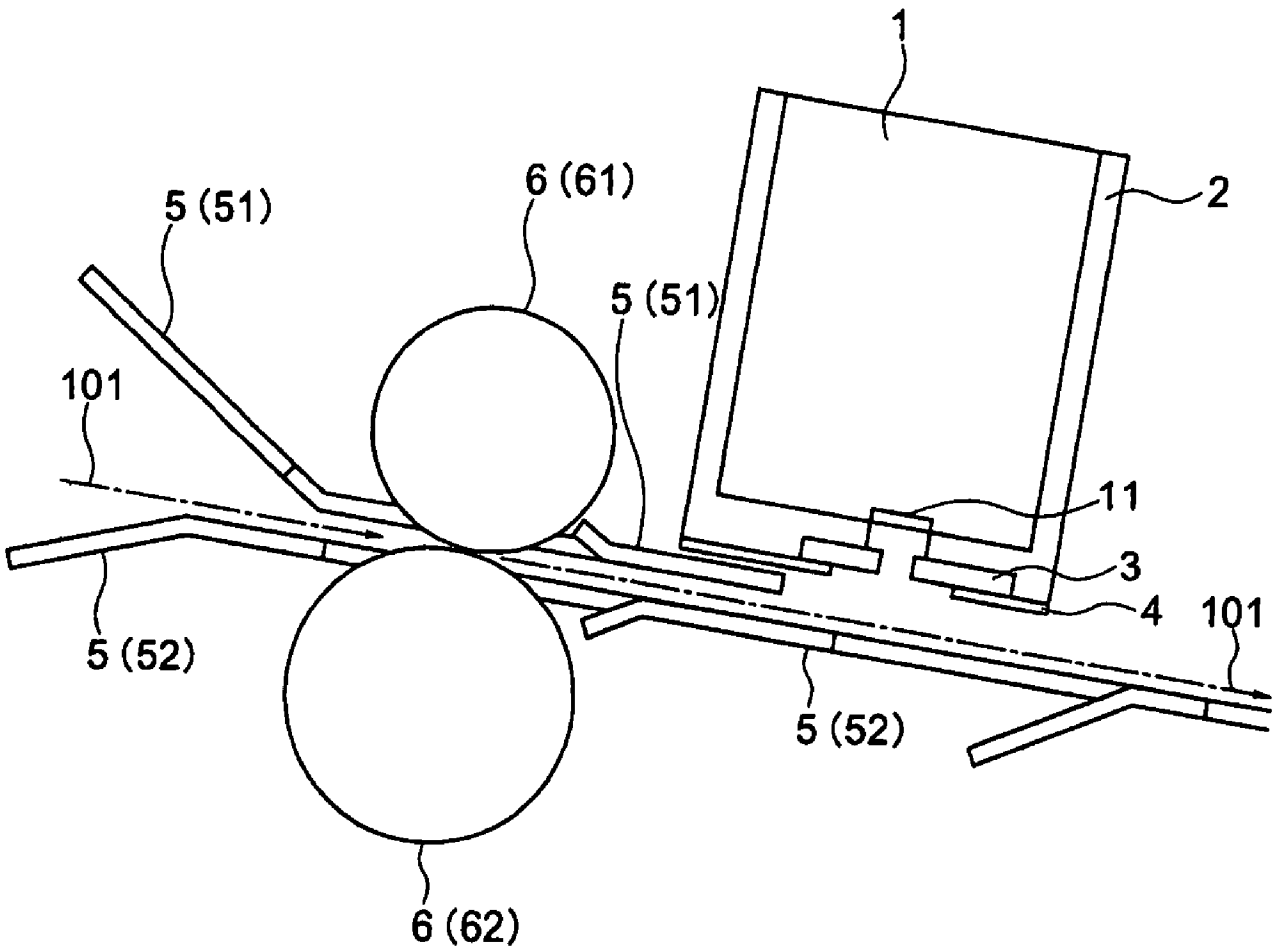
FIG. 1 is a constitutional view of an ink recording apparatus of the present invention.

FIG. 1 is a diagram showing the constitution of an ink recording apparatus, which shows one embodiment of a schematic section of the ink recording apparatus of the invention.

This ink recording apparatus is an in-printer that performs printing on paper processed by an image scanner device. Such the in-printer prints on a slip read by, for example, an image scanner part (not shown), print numbers (numerals) in reading order. Therefore, since the printing position is limited, and characters and numerals to be printed are also limited, printing can be performed sufficiently at even high paper transport speed.

According to the investigation of the inventor, as described before, as the paper transport speed becomes higher, the transport blow is produced. Exactly speaking, though the transport blow is produced at the even low paper transport speed, when the transport speed becomes higher than a predetermined speed, the influence on the ink mist (accordingly, the influence on recording quality) cannot be neglected. Specifically, the influence on the ink mist, when the paper transport speed is 45 PPM (Page Per Minutes) and more, is produced. Further, in case that the paper transport speed is so high, the amount of the produced static electricity is also large.

Therefore, the ink recording apparatus of the invention includes units for removing the influence of the transport blow on the ink mist, and units for removing the influence of the static electricity on the ink mist, which does not conflict with the aforesaid units for the transport blow. Therefore, the ink recording apparatus of the invention includes an ink head 1, a holder 2, an absorber 3, a mask 4, a transport guide 5, and a transport roller 6 that have the following constitution.

As shown in FIG. 1, the ink head 1 includes a nozzle 11 on its opposite surface (bottom surface) opposed to a medium 100 such as paper (refer to FIGS. 3A and 3B) or a transport path 101 for the medium, and ejects (jets) ink from this nozzle 11 toward the medium 100. The nozzle 11 is made of metal and provided nearly in the center of the opposite surface. The nozzle 11 or the opposite surface is arranged so as to be opposed to the transport path 101 of the medium 100 (namely, faced downward), whereby the ink ejected from the nozzle 11 substantially perpendicularly strikes the medium 100.

The holder 2 holds the ink head (ink cartridge) 1, includes a holder opening 21 (refer to FIGS. 2A and 2B) in a position corresponding to the nozzle 11, and covers the opposite surface of the ink head 1 except the nozzle 11. The holder opening 21 is formed so as to expose only the ejection surface of the nozzle 11 on the opposite surface. Hereby, without covering an air hole (not shown) of the nozzle 11, the holder opening can be formed in the simple shape. By provision of the holder opening 21, it is possible to prevent the holder 2 from becoming an obstruction when the ink ejected from the nozzle 11 is shot at the medium 100. Actually, the holder 2, as shown in FIG. 1, covers the whole (except the upper surface) of the ink recording apparatus (in-printer) to hold the ink recording apparatus, and fixes this ink recording apparatus to a housing (not shown) of the image scanner device.

The holder 2 is, because of electric insulation between the metallic nozzle 11 and the holder 2, made of insulating material, for example, resin (plastics). Specifically, since the ink is conductive, when the absorber 3 that has absorbed the ink and the nozzle 11 contact each other, they short, so that a very small amount of electric current flows in the nozzle 11. The holder 2 prevents the absorber 3 and the nozzle 11 from shorting by contacting each other. Further, when the absorber 3 and the nozzle 11 contact each other, due to a straw phenomenon, the absorber 3 sucks out the ink in the ink head 1 till the ink runs out. The holder 2, so that the ink is not sucked out by the contact between the absorber 3 and the nozzle 11, shields the space between the absorber 3 and the nozzle 11.

The absorber 3 includes an absorber opening 31 (refer to FIGS. 2A and 2B) in a position corresponding to the nozzle 11, and covers the surface of the holder 2 at least around the holder opening 21. The absorber opening 31 corresponds to the nozzle 11 and the holder opening 21, and the absorber 3 to cover a part of the surface of the holder 2, which is adjacent to the holder opening 21. By provision of the absorber opening 31, it is possible to prevent the absorber 3 from becoming an obstruction when the ink ejected from the nozzle 11 is shot at the medium 100. On the other hand, the absorber 3, even if the ink ejected from the nozzle 11 flows with the transport blow and attaches onto the absorber 3, can absorb the attached ink. Therefore, it is possible to prevent the attached ink from splashing by the transport blow and causing the stains due to the ink mist.

The absorber 3 is made of insulating material, for example, felt. Hereby, the absorber 3, while insulating electrically the portion between the metallic nozzle 11 and the absorber 3, can absorb the attached ink. The felt can absorb the ink better than cloth. However, in case that the felt is used, beard-shaped fiber can protrude into a passage of the ink ejected from the nozzle 11 (that is, inside the absorber opening 31). In this case, the ejected ink is stored in this beard-shaped fiber little by little, and there is possibility that the medium 100 such as the paper will be stained with this stored ink.

Therefore, as the absorber 3, insulating and hydrophilic continuous foam urethane is preferably used. This insulating urethane is super absorbing urethane that absorbs the ink, which has the continuous foam structure that is liquid-sintered. Hereby, this urethane can absorb the ink better than the felt, and can prevent the beard-shaped fiber from protruding into the passage of the ink.

As the absorber 3, conductive and hydrophilic continuous foam urethane is more preferably used. This conductive urethane is super absorbing urethane that absorbs the ink, which has the continuous foam structure that is liquid-sintered and electric conductivity. The electric conductivity is appropriately controlled by adding appropriately an additive such as carbon to the insulating urethane. Hereby, this urethane can absorb the ink better than the felt, and can prevent the beard-shaped fiber from protruding into the passage of the ink. Further, in case that the medium 100 such as the paper is charged, by discharging (corona-discharging) this charged medium, the static electricity can be removed (or reduced). Namely, the ink, regardless of whether it is conductive or not, is easier to be absorbed in the conductive absorber than in the non-conductive absorber 3 by causing the discharge (corona discharge) in the conductive absorber 3. Therefore, the conductive absorber 3 can absorb the ink more.

The mask 4 includes a mask opening 41 (refer to FIGS. 2A and 2B) in a position corresponding to the nozzle 11, and covers the surface of the absorber 3, thereby to prevent the stain of the transported medium 100 due to the contact of the medium 100 with the absorber 3. Namely, the mask opening 41 corresponds to the nozzle 11, the holder opening 21 and the absorber opening 31, the mask 4 is arranged between the absorber 3 and the medium 100. The mask 4 is made of conductive material such as metal, for example, stainless. By provision of the mask opening 41, it is possible to prevent the mask 4 from becoming an obstruction when the ink ejected from the nozzle 11 is shot against the medium 100. On the other hand, since the mask 4 is conductive, in case that the medium 100 such as the paper is charged, by discharging (corona-discharging) the charged paper, the static electricity can be removed (or reduced), and it is possible to prevent the medium 100 such as the paper from attaching to the mask 4.

The holder 2, into which the ink head 1 is put, is fixed to the ink head 1, for example, with screws (not shown). The mask 4 is attached and fixed to the holder 2, for example, with screws (not shown). The absorber 3, as shown in FIG. 1, is set so as to be fitted into a stepped portion provided at the predetermined portion of the holder 2, and put and fixed between the holder 2 and the mask 4.

Figure 2A:
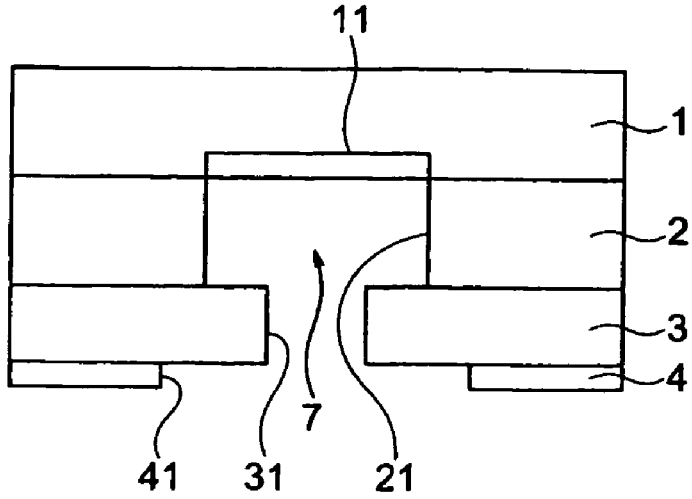
FIGS. 2A and 2B are explanatory views of the ink recording apparatus.
Figure 2B:
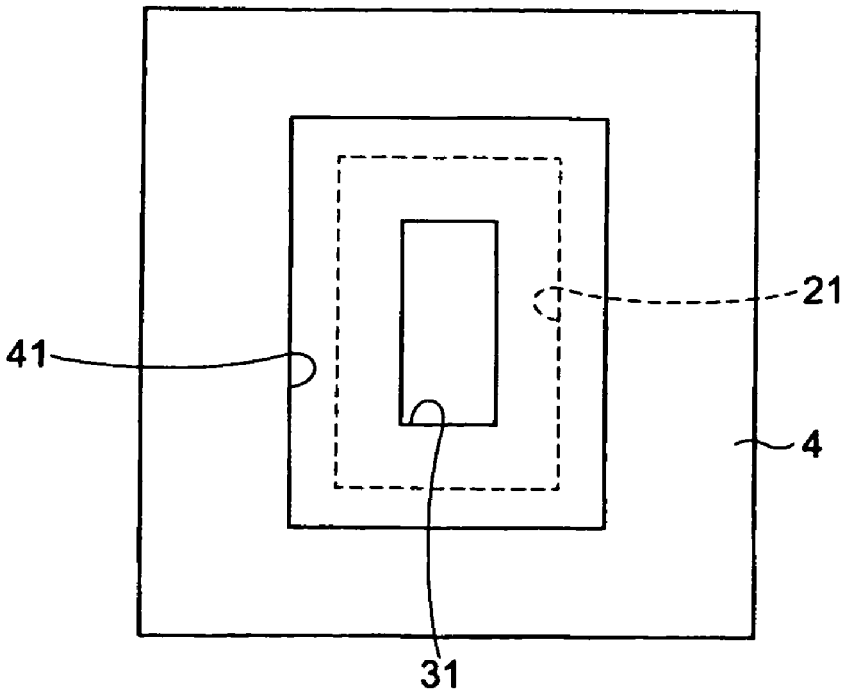

FIGS. 2A and 2B show the relation among shapes of the holder opening 21, the absorber opening 31 and the mask opening 41. FIG. 2A is an enlarged sectional view of the vicinity of these openings, and FIG. 2B is an enlarged plan (bottom) view of the vicinity of these openings.

In this embodiment, the holder opening 21, the absorber opening 31 and the mask opening 41 are rectangular. The absorber opening 31 has the shape in which the end portion of the absorber 3 protrudes in the peaked shape greater than the end portion of the holder 2 in the entire area around the holder opening 21 (in four sides of a rectangle). The protruding lengths of the absorber 3 from the holder 2 may be the same or different in the same and opposite directions of the transport direction of the medium and in the orthogonal direction to this transport direction. Further, the mask opening 41 is larger than the absorber opening 31, and has the shape in which the end portion of the absorber 3 is exposed in the entire area around the absorber opening 31. Namely, the absorber opening 31 is smaller than the holder opening 21 and the mask opening 41.

Hereby, a space 7 formed at the upper portion of the nozzle 11 defined by the holder opening 21, the absorber opening 31 and the mask opening 41 is not a mere recess part, as shown in FIG. 2A, but a space (so-called pot-shaped space) in which the longitudinal and lateral sizes of the internal cavity (defined by the holder opening 21) is larger than the longitudinal and lateral sizes of the opening (defined by the holder opening 31). Further, the relation of projection planes among the holder opening 21, the absorber opening 31 and the mask opening 41 is, as shown in FIG. 2B, that the area of the absorber opening 31 is smaller than the area of the holder opening 21.

Figure 3A:
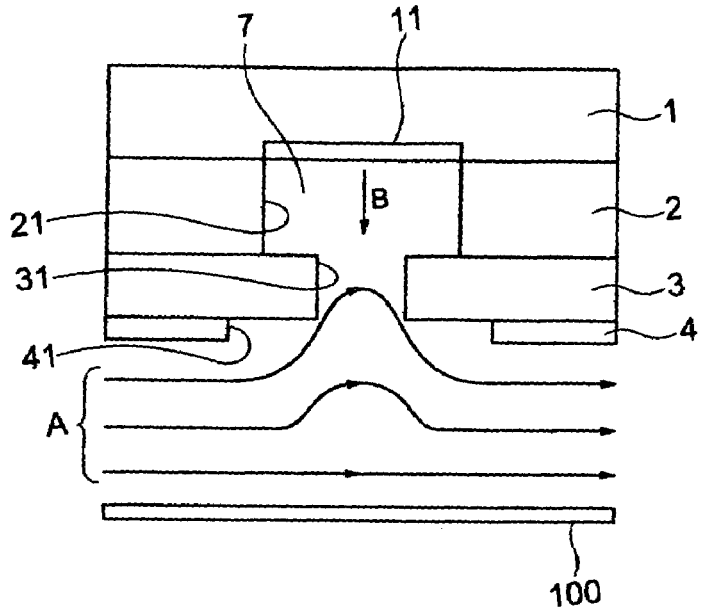
FIGS. 3A and 3B are explanatory views of the ink recording apparatus.

By such the structure, the schematic flow of a transport blow A produced by high-speed transport of the medium 100 such as the paper is as shown in FIG. 3A. Namely, the transport blow A hardly comes into (is hardly engulfed in) the space 7. Therefore, since the transport blow A does not blow directly against the ejection part (nozzle 11) of the ink, an ink droplet 8 of the ink ejected in the direction of an arrow B jets in its proper direction.

Figure 3B:
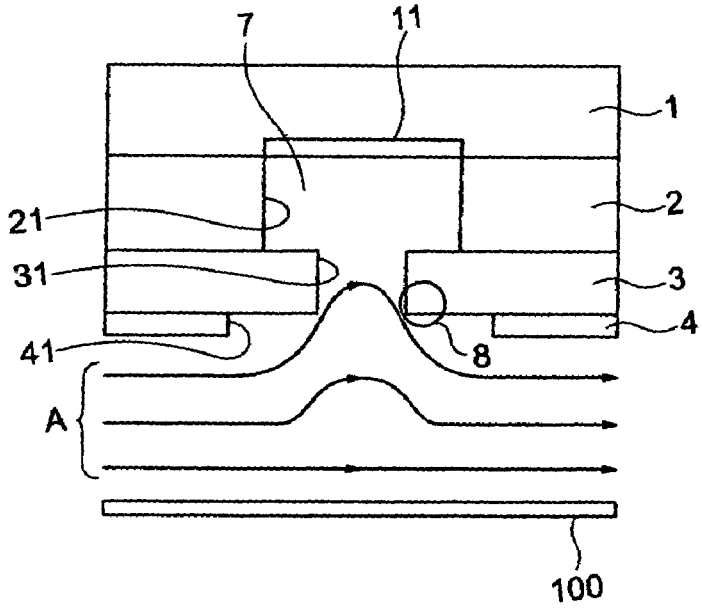

Therefore, though the ink ejected in the direction of the arrow B is hardly affected by the transport blow A, a part of the ink can be affected by the transport blow A. However, even in this case, the affected ink droplet 8 of the ink, as shown in FIG. 3B, almost attaches, in the exit of the space 7, to the absorber 3 (angle portion of the absorber) on the downstream side of the blow (on the downstream side of the transport path 101 of the medium 100). This depends on the shape of the space 7. As described later, the attached ink droplet 8 of the ink can be absorbed by the absorber 3. Further, the ink droplet 8 that has attached to the holder 2 by the influence of the transport blow A, without being absorbed by the resin-made holder 2, moves by the influence of the transport blow A and attaches to the absorber 3. Further, the ink droplet 8 affected by the transport blow A hardly attaches to the mask 4 due to the shape of the space 7. Hereby, it is possible to prevent the ink droplet 8 of the ink from attaching to the holder 2 or the mask 4 and causing the stains.

As described above, according to the invention, the influence on the ink by the transport blow can be extremely lessened. Therefore, it is possible to prevent the ink droplet (shot) that has been ejected and become misty from flowing by this transport blow. Hereby, it is possible to prevent the mist, the nozzle stain and the mask stain caused by the attachment of the ink mist onto the paper, the nozzle and the mask due to the transport blow from being produced respectively.

Figure 4A:
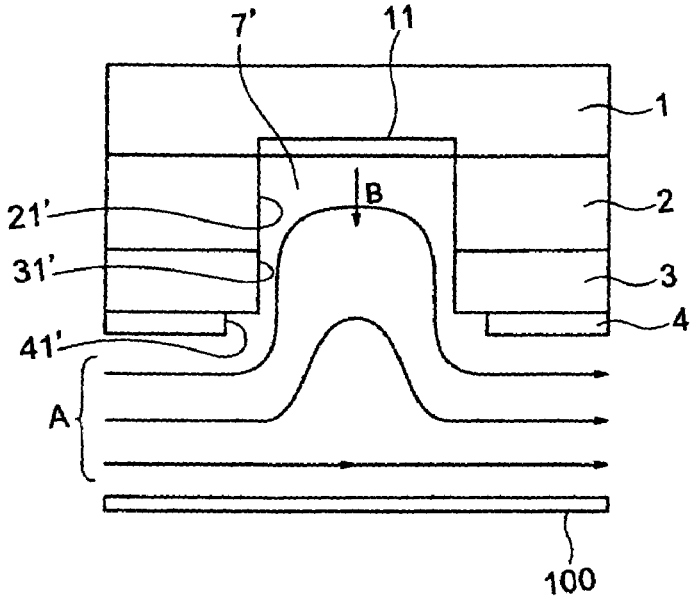
FIGS. 4A and 4B are comparative views with respect to FIGS. 3A and 3B.
Figure 4B:
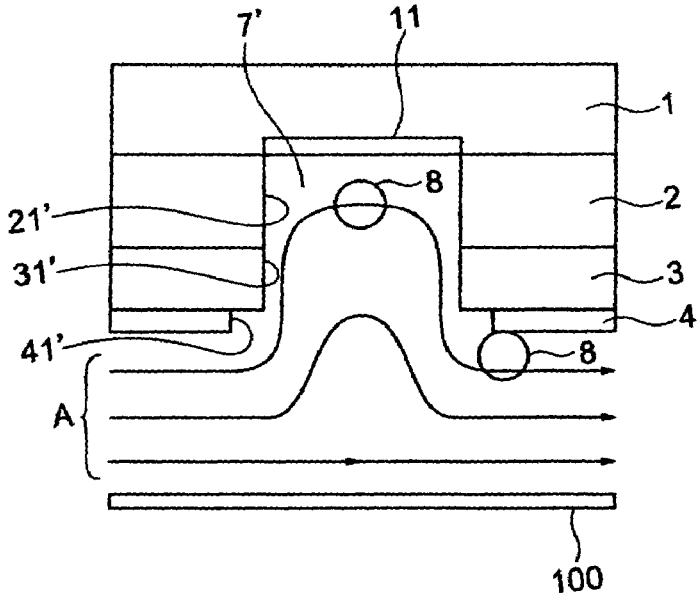

FIGS. 4A and 4B, as comparison with the case in FIGS. 3A and 3B, show a case in which a space 7' formed at the upper portion of the nozzle 11 defined by a holder opening 21', an absorber opening 31' and a mask opening 41' is a mere recess part. Namely, FIGS. 4A and 4B show the case in which the absorber opening 31' and the mask opening 41' are wider than the holder opening 21'. Further, FIGS. 4A and 4B corresponds to FIGS. 3A and 3B, and suppose the case in which the absorber opening 31' is formed in the equal shape to the shape of the holder opening 21', and the mask opening 41' is intactly formed in the shape in FIGS. 3A and 3B.

In this case, as shown in FIG. 4A, since the space 7' is the mere recess part, the transport blow A reaches up to (is engulfed in) the inside of the space 7'. Therefore, since the transport blow A substantially directly blows against the ejection part (nozzle 11) of the ink, the ink droplet 8 of the ink ejected in the direction of an arrow B becomes difficult to jet in its proper direction.

Therefore, a part of the ink ejected in the direction of the arrow B can be affected by the transport blow A substantially strongly. In this case, as shown in FIG. 4B, the affected ink droplets 8 hardly attaches, in the exit of the space 7', to the absorber 3 (angle portion of the absorber) on the leeward side, and attaches to the mask 4 because of the shape of the space 7', which has high possibility of the cause of stains.

Figure 5A:
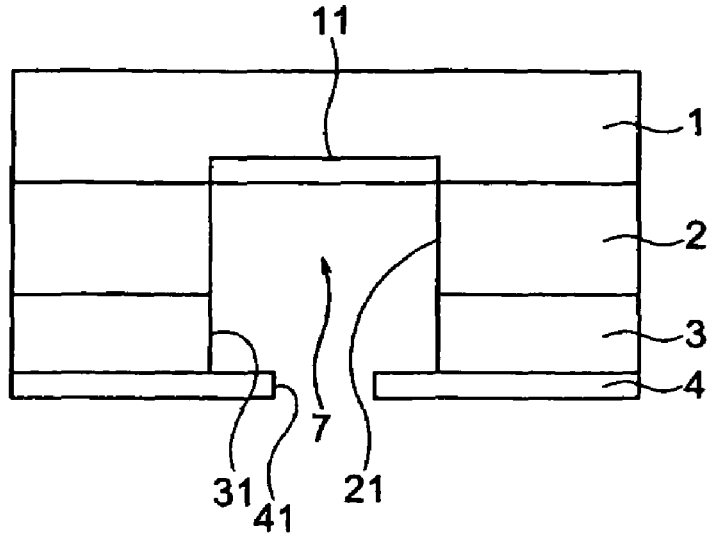
FIGS. 5A and 5B are explanatory views of the ink recording apparatus.
Figure 5B:
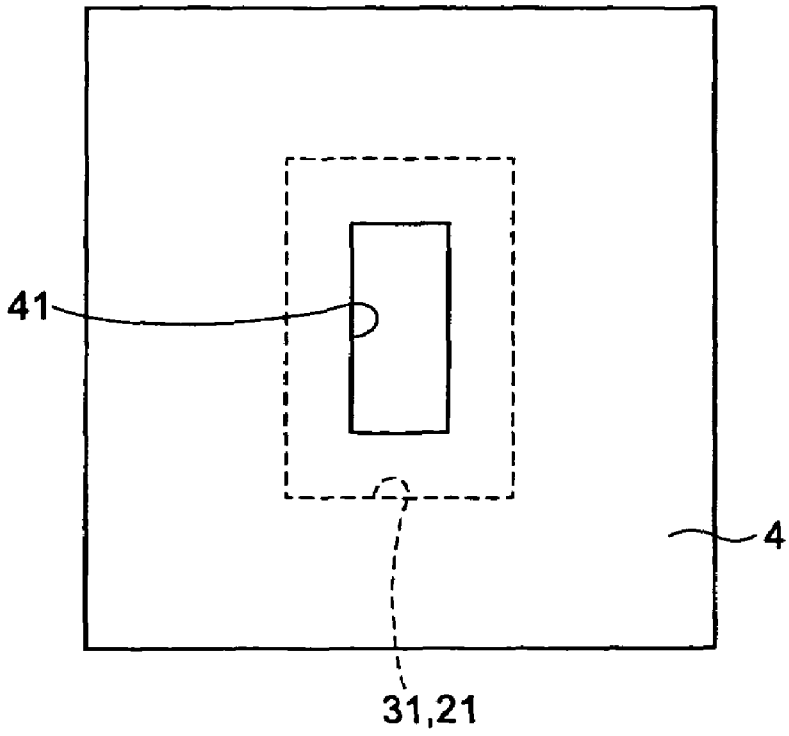

Further, among the holder opening 21, the absorber opening 31 and the mask opening 41, the relation of their shapes may be as shown in FIGS. 5A and 5B. FIGS. 5A and 5B correspond respectively to FIGS. 2A and 2B.

In the embodiment shown in FIGS. 5A and 5B, the mask opening 41 has the shape in which the end portion of the mask 4 protrudes in the peaked shape greater than the end portion of the holder 2 (and the absorber 3) in the entire area around the holder opening 21 (and the absorber opening 31). Further, the absorber opening 31 is formed in the equal shape to the shape of the holder opening 21. Namely, the holder opening 21 and the absorber opening 31 has an identical shape, and the mask opening is smaller than the holder opening 21 and the absorber opening 31. Hereby, a space 7 is not a mere recess part, as shown in FIG. 5A, but has the pot shape as described before. By such the structure, regarding prevention of the stains, advantages similar to those in the cases of FIGS. 2A, 2B, 3A and 3B can be obtained.

Figure 6:
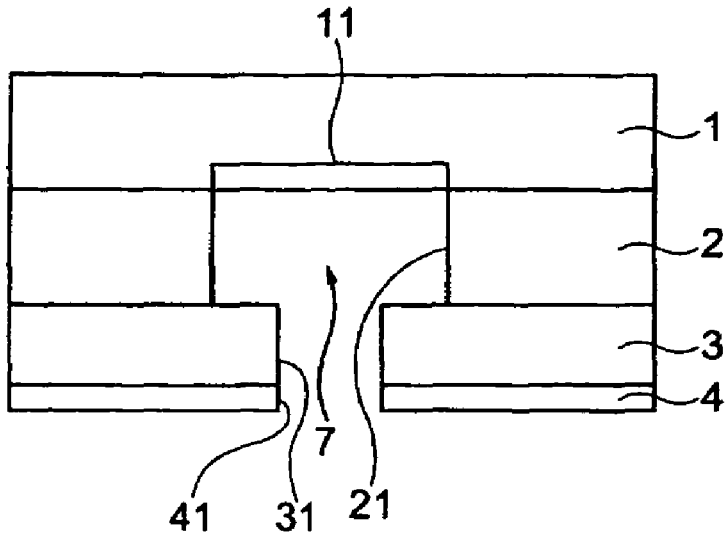
FIG. 6 is an explanatory view of the ink recording apparatus.

Further, among the holder opening 21, the absorber opening 31 and the mask opening 41, the relation of their shapes may be as shown in FIG. 6. FIG. 6 corresponds to FIG. 2A.

In the embodiment shown in FIG. 6, the absorber opening 31 and the mask opening 41 have the shape in which the end portions of the absorber 3 and the mask 4 protrude in the peaked shape greater than the end portion of the holder 2 in the entire area around the holder opening 21. Further, the absorber opening 31 is formed in the equal shape to the shape of the mask opening 41. Namely, the absorber opening 31 and the mask opening 41 are smaller than the holder opening 21, the absorber opening 31 and the mask opening 41 has an identical shape. Hereby, a space 7 is not a mere recess part, as shown in FIG. 6, but has the pot shape as described before. By such the structure, regarding prevention of the stains, advantages similar to those in the cases of FIGS. 2A, 2B, 3A and 3B can be obtained.

Figure 7:
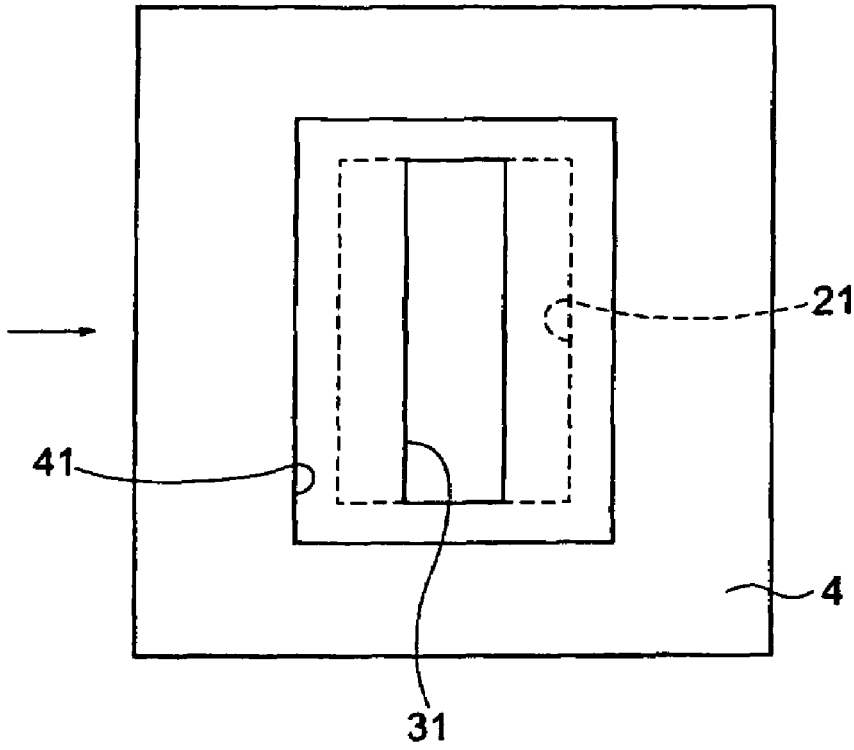
FIG. 7 is an explanatory view of the ink recording apparatus.

Further, among the holder opening 21, the absorber opening 31 and the mask opening 41, the relation of their shapes may be as shown in FIG. 7. FIG. 7 corresponds to FIG. 2B.

In the embodiment shown in FIG. 7, the absorber opening 31 has the shape in which the end portion of the absorber 3 protrudes in the peaked shape greater than the end portion of the holder 2 in the same and opposite directions of the transport direction of the medium 100 around the holder opening 21 (in two sides of the rectangle of the holder opening 21 which are perpendicular to the transporting direction). Namely, the absorber opening 31 is smaller than the holder opening 21 in the transport direction. In FIG. 7, the transport direction is shown by an arrow. The absorber opening 31 has, in the direction orthogonal to the transport direction of the medium 100 around the holder opening 21 (in other two sides of the rectangle of the holder opening 21 which are parallel to the transport direction), the same shape as the shape of the end portion of the holder 2. Further, the mask opening 41, similarly to the embodiment shown in FIGS. 2A and 2B is larger than the absorber opening 31, and has the shape in which the end portion of the absorber 3 is exposed in the entire area around the absorber opening 31. Hereby, though a space 7 is not a mere recess part and not a completely pot-shaped space, it is, only in the transport direction of the medium 100, a pot-shaped space 7 as described before. Since the influence of the transport blow is large in the transport direction of the medium 100, according to the embodiment in FIG. 7, the influence of the transport blow in that direction can be nearly eliminated as shown in FIGS. 3A and 3B. Therefore, by such the structure, regarding prevention of the stains, advantages similar to those in the case of FIGS. 2A, 2B, 3A and 3B can be obtained.

Further, the embodiment in FIG. 7 may be applied to the embodiments in FIGS. 5A, 5B and 6. Namely, the mask opening 41 may have the shape in which the end portion of the absorber 3 protrudes in the peaked shape greater than the end portions of the holder 2 and the absorber 3 in the same and opposite directions of the transport direction of the medium 100 around the holder opening 21 and the absorber opening 31 (in two sides of the rectangle of the mask member opening 41 which are perpendicular to the transport direction). Alternatively, the absorber opening 31 and the mask opening 41 may have the shape in which the end portions of the absorber 3 and the mask 4 protrude in the peaked shape greater than the end portion of the holder 2 in the same and opposite directions of the transport direction of the medium 100 around the holder opening 21 (in two sides of the rectangle of the holder opening 21 which are perpendicular to the transport direction).

Therefore, according to the invention, at least one of the absorber opening 31 and the mask opening 41 should have the shape in which the end portion of at least one of the absorber 3 and the mask 4 protrudes in the peaked shape greater than the end portion of the holder 2 at least in the same and opposite directions of the transport direction of the medium 100 around the holder opening 21. In other words, at least one of the absorber opening 31 and the mask opening 41 are smaller than the holder opening 21 at least in the transport direction.

In the recording apparatus of the invention, the nozzle 11 may be a nozzle array that includes a plurality of the nozzles. In the case that the nozzle 11 of the above embodiments is the nozzle array, the apparatus may be provided with the holder opening 21, the absorber opening 31 and the mask opening 41, which correspond to the nozzle array, and may be provided with a plurality of the holder openings 21, the absorber openings 31 and the mask openings 41, which correspond to each of the plurality of the nozzles.

The transport guide 5 is a guide for transporting the medium 100, and the guide 5 is provided along the transport path 101 of the medium 100 and provided with a static electricity removing unit 53 for removing static electricity. In this embodiment, the transport guides 5 are provided up and down with the transport path 101 of the medium 100 between. Hereby, it is possible to prevent the medium 100 transported at a high speed from deviating from the transport path 101.

Figure 8:
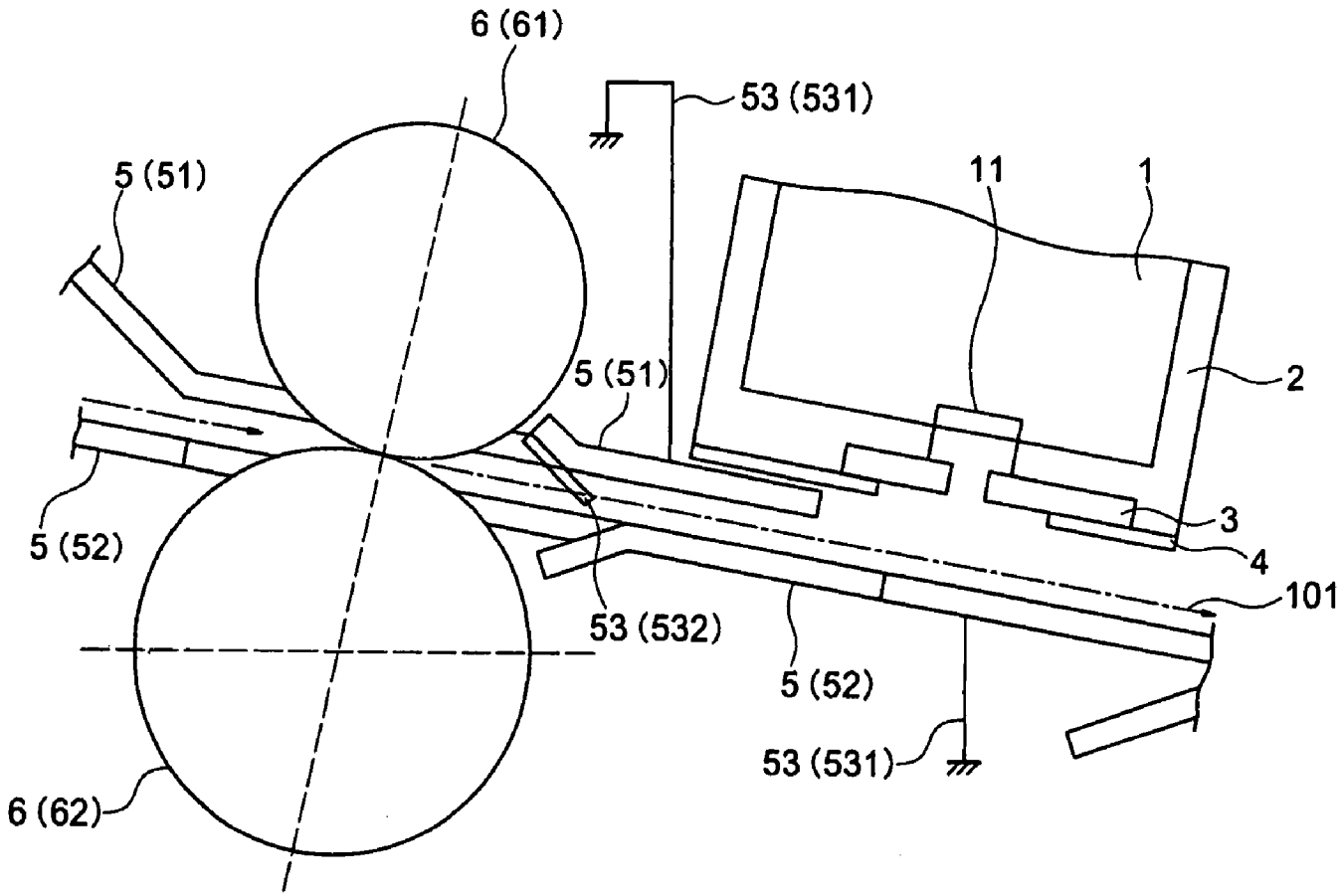
FIG. 8 is a constitutional view of the ink recording apparatus

The static electricity removing unit 53, as shown in FIG. 8, is composed of a ground unit 531 that grounds a part or the whole of the metallic transport guide 5. The ground unit 531 is provided in case that the transport guide is made of conductive material, for example, metal. The ground unit 531 removes the static electricity by which the medium 100 such as the paper is charged. The transport guide 5, at its part, for example, a part or the whole of an upper guide 51, a part of the whole of a lower guide 52, or parts of the upper guide 51 and the lower guide 52 are metallic, and each of them is grounded. Alternatively, the transport guide, at its whole, that is, at the whole of the upper guide 51 and the whole of the lower guide 52 is metallic, and each of them is grounded.

Alternatively, the static electricity removing unit 53 is composed of a static electricity removing (electricity removal) bar 532. The electricity removal bar 532, as shown in FIG. 8, hangs down so as to intersect the transport path 101 of the medium 100, and is formed by coupling plural conductive materials that are softer than the medium 100, in the perpendicular direction to the paper surface. In case that the electricity removal bar 532 is set, the transport guide 5 may be formed of non-conductive material, for example, resin (plastics). The electricity removal bar 532 is provided, in the transport path 101 of the medium 100, between the transport roller 6 and the nozzle 11, and removes the static electricity by which the medium 100 is charged. The electricity removal bar 532, as shown in FIG. 8, is provided at a part of the transport guide 5, for example, only the upper guide 51. Alternatively, the electricity removal bar 532 may be provided at a part of the transport guide 5, for example, only the lower guide 52, or the whole of the transport guide 5, for example, both of the upper guide 51 and the lower guide 52.

In this embodiment, actually, as the static electricity removing unit 53, both of the ground unit 531 of the metallic transport guide 5 and the electricity removal bar 532 are provided. Namely, the whole of the upper guide and the whole of the lower guide 52 are made of metal and each of them is grounded by the ground unit 531, and the electricity removal bar 532 is provided only for the upper guide 51. Hereby, from the charged medium 100 such as the paper, the static electricity can be removed.

The transport roller 6 is a roller for transporting the medium 100, and it is provided on the upstream side of the ink head 1 in the transport direction of the medium 100. The transport rollers 6 are set up and down in its position with the transport path 101 of the transporting medium 100 between. One of the upper and lower transport rollers 6 is a drive roller which is driven so as to rotate in the predetermined direction by a motor and a gear, and the other is a driven roller. Both of the upper and lower transport rollers may be drive rollers.

In this embodiment, a part or the whole of the transport roller 6 is made of conductive material. In case that a part of the transport roller 6 is made of conductive material, a part of the transport roller 6 in the width direction (direction orthogonal to the transport direction) of the medium 100 is made of the conductive material, and the entire periphery in the rotational direction in the above part is made of the conductive material. As the conductive material, conductive urethane or metal is used. Hereby, the static electricity produced when the medium 100 during transporting is separated from the transport rollers 6 is discharged (corona-discharged), whereby it is possible to prevent the medium 100 from being charged.

In this embodiment, since the static electricity removing unit 53 is provided at the transport guide 5, as shown by a dotted line in FIG. 8, the upper and lower transport rollers 6 are provided so that a line segment (engagement axis) connecting centers of the sections of the upper and lower transport rollers 6 is inclined to the downstream side in the transport direction from the perpendicular direction to the transport direction. Specifically, the upper roller (driven roller 61) is moved more backward (to the downstream side) than the lower roller (drive roller 62). Hereby, the medium 100 to be transported comes always into contact with the lower guide 52, whereby the static electricity can be removed from the charged medium 100.

To the contrary to the embodiment in FIG. 8, the upper and lower transport rollers 6 may be provided so that the line segment connecting centers of the sections of the upper and lower transport rollers 6 is inclined to the upstream side in the transport direction from the perpendicular direction to the transport direction. Specifically, the upper roller (driven roller 61) is moved more forward (to the upstream side) than the lower roller (drive roller 62). Hereby, the medium 100 to be transported comes always into contact with the upper guide 51, whereby the static electricity can be removed from the charged medium 100.

Therefore, according to the invention, the static electricity removing unit 53 is provided at the transport guide 5, and the upper and lower transport rollers 6 are provided so that the engagement axis of the upper and lower transport rollers 6 is inclined to the upstream side or the downstream side in the transport direction from the perpendicular direction to the transport direction. Hereby, the medium 100 comes always into contact with the upper or lower guide during being transported, whereby the static electricity can be removed from the charged medium 100.

In the image scanner device, the medium 100 such as the paper from which the image has read by the scanner is transported at a high speed to the ink recording apparatus shown in FIG. 1 which is the in-printer. In the in-printer, even if the medium 100 is charged, it is electricity-removed by the transport guide 5 grounded by the ground unit 531, and thereafter electricity-removed by the conductive transport roller 6. Further, on the downstream side of the transport roller 6, the medium is electricity-removed by the electricity removal bar 532, and comes always into contact with the metallic lower guide 52 due to the inclination of the transport roller 6 thereby to be electricity-removed. Thereafter, the medium 100 reaches just under the nozzle 11 of the ink head 1, and printed (recorded) by ink. At this time, the medium 100 has been already electricity-removed nearly. On the other hand, the transport blow hardly affects the ink, even if the transport blow affects the ink, the affected ink is almost absorbed by the absorber 3. Therefore, clean recording is possible. Thereafter, the medium 100 is, without attaching to the absorber 3 (which has absorbed the ink) by the mask 4, separates from the ink recording apparatus and transported to the downstream side. The medium 100, at this time, is electricity-removed by the mask 4, and thereafter electricity-removed by the transport guide 5. Therefore, the medium 100 does not attract the ink mist thereby to not be stained.

As described above, according to the invention, in the ink recording apparatus, the shape of the holder opening, the absorber opening and the mask opening are defined so that at least one of the absorber opening and the mask opening has the shape in which the end portion protrudes greater than the end portion of the holder, in the peaked shape, at least in the same and opposite direction of the transport direction of the medium. Hereby, even in case that the transport blow is produced by high-speed transport by the medium, it is possible to prevent the ejected ink droplet from flowing by the transport blow. Hereby, it is possible to prevent the mist, the nozzle stain and the mask stain caused by the attachment of the ink mist onto the paper, the nozzle and the mask due to the transport blow from being produced. In result, the stains due to the ink mist can be prevented, and recording quality of the ink recording apparatus can be improved.

Further, according to the ink recording apparatus of the invention, since the transport roller made of the conductive material is provided, the occurrence of the static electricity on the medium such as the paper that is transported at a high speed can be suppressed without obstructing the prevention unit for the stains due to the transport blow.

Further, according to the ink recording apparatus of the invention, since the transport guide including the static electricity removing unit is provided, the static electricity produced on the medium such as the paper that is transported at a high speed can be removed without obstructing the prevention unit for the stains due to the transport blow.

Further, according to the ink recording apparatus of the invention, the hydrophilic and super absorbing urethane is used as the absorber. Therefore, even in case that the ejected ink droplet flows by the transport blow, regarding the ink droplet that has attached to the absorber, the absorber absorbs this, whereby the cause of the stain can be prevented.

What is claimed is:

1. An ink recording apparatus, operable to eject ink to a medium transported in a transport path in a transport direction, the ink recoding apparatus comprising:

an ink head, including a nozzle on a bottom surface opposed to the transport path, and operable to eject the ink from the nozzle to the medium;

a holder, adapted to hold the ink head and to cover the bottom surface, and including a first opening corresponding to the nozzle;

an absorber, adapted to cover a part of the holder which is opposed to the transport path and is adjacent to the first opening, and including a second opening corresponding to the nozzle; and a mask, adapted to be arranged between the absorber and the transport path, and including a third opening corresponding to the nozzle, wherein at least one of an end portion of the second opening and an end portion of the third opening protrudes greater than an end portion of the first opening at least in the transport direction and an opposing direction opposed to the transport direction.

2. The ink recording apparatus according to claim 1, wherein the end portion of the second opening protrudes greater than the end portion of the first opening and the end portion of the third opening.

3. The ink recording apparatus according to claim 1, wherein the ink recording apparatus includes an in-printer that performs printing on paper processed by an image scanner.

4. The ink recording apparatus according to claim 1, further comprising a roller, comprised of a conductive material, and adapted to transport the medium, the roller located at an upstream side of the ink head in the transport direction.

5. The ink recoding apparatus according to claim 4, wherein the conductive material includes urethane.

6. The ink recoding apparatus according to claim 4, wherein the conductive material includes metal.

7. The ink recording apparatus according to claim 1, further comprising a guide, provided along the transport path, and including a static electricity remover operable to remove static electricity.

8. The ink recording apparatus according to claim 7, wherein the static electricity remover includes at least one of a static electricity removing bar provided at at least a part of the guide and a grounding member by which at least a part of the guide is grounded.

9. The ink recording apparatus according to claim 7, further comprising a pair of rollers, adapted to transport the medium, and located at an upstream side of the ink head in the transport direction, wherein the rollers are arranged at opposite sides of the transport path so that a line connecting axes of the rollers is inclined with respect to the transport path.

10. The ink recording apparatus according to claim 1, wherein the absorber is comprised of an insulating felt.

11. The ink recording apparatus according to claim 1, wherein the absorber is comprised of insulating and hydrophilic continuous foam urethane.

12. The ink recording apparatus according to claim 1, wherein the absorber is comprised of conductive and hydrophilic continuous foam urethane.

13. An ink recording apparatus, operable to eject ink to a medium transported in a transport path in a transport direction, the ink recoding apparatus comprising:

an ink head, including a nozzle opposed to the transport path, and operable to eject the ink from the nozzle to the medium;

a holder, holding the ink head, and including a first opening corresponding to the nozzle;

an absorber, including a second opening corresponding to the nozzle and the first opening; and a mask, including a third opening corresponding to the nozzle, the first opening and the second opening, wherein the first, second and third openings are arranged in this order from the nozzle toward the transport path, and at least one of the second opening and the third opening is smaller than the first opening.

14. The ink recording apparatus according to claim 13, wherein the at least one of the second opening and the third opening is smaller than the first opening at least in the transport direction.

15. The ink recording apparatus according to claim 13, wherein the second opening is smaller than the first opening and the third opening.

* * * * *